United States Patent [19]

Schnöring et al.

[11] 4,379,836

[45] Apr. 12, 1983

[54] PROCESS FOR THE PRODUCTION OF DISPERSIONS AND PHOTOGRAPHIC MATERIALS

[75] Inventors: Hildegard Schnöring, Wuppertal; Karl-Wilhelm Schranz; Günther Koepke, both of Odenthal, all of Fed. Rep. of Germany

[73] Assignee: Agfa-Gevaert Aktiengesellschaft, Leverkusen, Fed. Rep. of Germany

[21] Appl. No.: 295,641

[22] Filed: Aug. 24, 1981

[30] Foreign Application Priority Data

Sep. 2, 1980 [DE] Fed. Rep. of Germany ..... 3033000

[51] Int. Cl.[3] ..... G03C 1/40

[52] U.S. Cl. ..... 430/377; 430/449; 430/512; 430/546; 430/569; 430/607; 430/631

[58] Field of Search ..... 430/449, 377, 546, 569, 430/642, 512, 607, 631

[56] References Cited

U.S. PATENT DOCUMENTS

| | | | |
|---|---|---|---|
| 3,788,857 | 1/1974 | Van Poucke et al. | 430/546 |
| 3,801,326 | 4/1974 | Claes | 430/642 |
| 3,850,643 | 11/1974 | Johnson et al. | 430/546 |
| 3,860,425 | 1/1975 | Ono et al. | 430/546 |
| 4,127,413 | 11/1978 | Ishihara et al. | 430/546 |
| 4,284,709 | 8/1981 | Tomka | 430/546 |

*Primary Examiner*—J. Travis Brown

*Attorney, Agent, or Firm*—Connolly and Hutz

[57] ABSTRACT

Process for the production of photographic emulsions consisting of water-immiscible or water-insoluble organic substances and an aqueous solution of an organic binder, characterized in that the hydrophilic and hydrophobic phases are heated separately, each to its particular temperature above its liquefaction point, and then continuously dosed into a dispersing chamber.

11 Claims, 2 Drawing Figures

PROCESS FOR THE PRODUCTION OF DISPERSIONS AND PHOTOGRAPHIC MATERIALS

Figure 1:
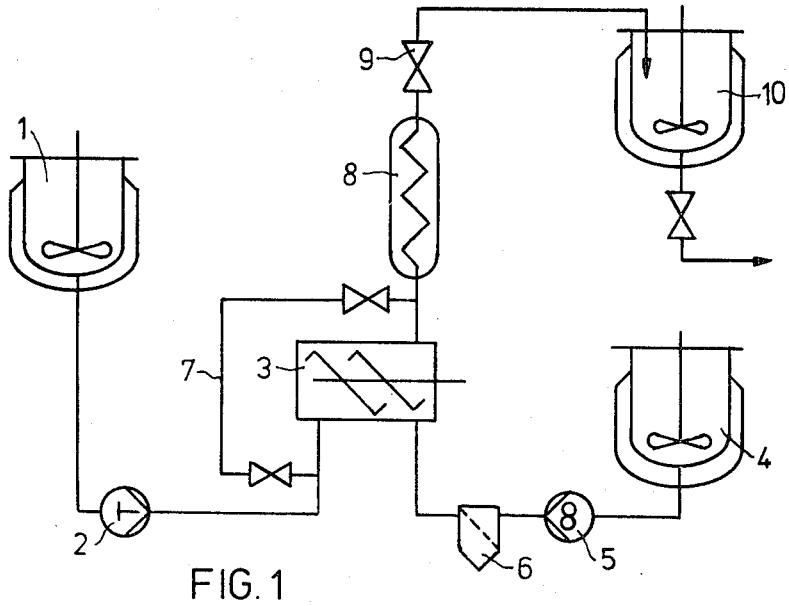

This invention relates to a process for the production of dispersions and to photographic materials containing such dispersions. The present invention relates in particular to the production of dispersions of organic hydrophobic substances in an aqueous phase.

The term "dispersions" is used herein to denote apparently homogeneous systems which contain at least two phases in finely divided form. Examples of such dispersions include emulsions and suspensions.

To prepare such dispersions, it is known to mix organic substances, in particular colour couplers, in a solid or liquid form, with high boiling solvents known as "oil-formers", optionally to add a low boiling auxiliary solvent, and to disperse this mixture with an aqueous solution, generally a gelatine solution, with the aid of an emulsifier. Such processes have been described in U.S. Pat. No. 2,322,027. It is clear from the Examples of U.S. Pat. No. 2,322,027 that relatively low temperatures are maintained during the process of dispersion. The use of low boiling auxiliary solvents has been described in many instances, but has the major disadvantage that the low boiling auxiliary solvent must be removed from the disperse phase by distillation after the process of dispersion. Considerable technical expenditure is required for complete removal of the solvent. This removal is generally carried out under reduced pressure and at low temperatures in order to avoid agglomeration of the disperse phase and undue exposure to heat of the binder which is in most cases sensitive to elevated temperatures.

From German Pat. No. 1,143,707, it is known to emulsify colour components having a melting point below 75° C. in a gelatine solution heated to 90° C., using an emulsifier. From British Pat. No. 1,151,590, it is known to use colour couplers having melting points down to below 100° C. These colour couplers are melted together with a dispersing agent. From DDR Pat. No. 139,040, it is known to use colour couplers having a melting point above 75° C., these couplers being mixed with a high boiling solvent and then emulsified in water containing a wetting agent. The resulting product may subsequently be mixed with a gelatine solution at a low temperature.

One disadvantage of such processes is that the colour couplers may only have a melting point of at the most 100° C. Although the step of separation of a low boiling auxiliary solvent is obviated, the processes are restricted to colour couplers which have a sufficiently low melting point or are capable of reaching such a melting point by admixture with other colour couplers or with oil-formers. Moreover, both in the solvent-free dispersion processes and in the processes using an oil-former, the step of dispersing by grinding is not applicable to all colour couplers, since it is technically difficult to capture the heat generated by the work of size reduction in the process of grinding. This difficulty is all the more serious the more finely the colour coupler particles are required to be dispersed and the narrower the required distribution range, that is to say the deviation of the individual particles from the average particle size, since most of the compounds to be dispersed resemble gelatine in being relatively temperature-sensitive. Gelatine readily undergoes irreversible changes at high temperatures, which manifest themselves in reduced ease of casting and inferior sensitometric values. In the known processes, the phases to be dispersed are mixed before dispersion and are together poured into the dispersion apparatus.

U.S. Pat. No. 3,850,643 discloses a process in which a coupler/oil-former mixture is dissolved in a solvent at 137.8° C. and the resulting solution is introduced into a gelatine/emulsifier solution within 5 minutes.

This requires the use of a specialised apparatus for introducing the solution, consisting of a fixed plate in the form of a ring and a perforated plate with webs. The solvent is subsequently washed out of the solidified emulsion.

The process has the disadvantage that it necessitates the use of a specialised apparatus which requires separate adjustment. Other disadvantages lie in the use of solvents which must subsequently be removed in a two-stage operation, and the very long time required for introduction of the solvent.

The present invention is directed to the problem of finding a process of dispersion which avoids the disadvantages of the known processes. The present invention particularly relates to the problem of providing a process of dispersion which would ensure mild conditions of treatment for the dispersed compounds.

A process for the production of dispersions from at least one liquid organic phase containing a hydrophobic, photographically-active compound and at least one aqueous phase containing a binder has now been found, in which the two phases are brought together and dispersed at the same time. According to the present invention, the two phases are introduced separately into a suitable dispersion apparatus.

In a preferred embodiment of the process, the organic phase is the pure melt of a photographic substance or the solution of photographic substance in an oil-former, and dispersion takes place above the liquefaction temperature of this photographically-active substance or of the solution.

The aqueous phase may contain dissolved binders and dispersion may be carried out above the liquefaction temperature of this binder solution. Dispersion may also be carried out above the liquefaction temperatures of the two phases.

In a preferred embodiment, dispersion is carried out at a temperature above the boiling point at normal pressure of the phase which has the lower boiling point or the azeotropic mixture, if formed. The organic phase preferably contains a photographically-active substance which is substantially immiscible with water at pH 7. In a preferred embodiment, it may in addition contain a high boiling oil-former.

The photographically-active compound may be for example a colour coupler, a stabilizer or a UV absorbent.

One particularly advantageous method of carrying out the process is distinguished by the fact that the residence time of a particle of organic phase in the shearing zone of the dispersion apparatus is at the most only 6 seconds.

The temperature in the dispersion chamber is advantageously at least 100° C. and the pressure in the dispersion chamber is advantageously at least one bar. One particular process involves a temperature of the organic phase of from 100° to 140° C. a temperature of the aqueous phase of from 70° to 85° C. and a temperature in the dispersion zone of from 60° to 140° C.

The process according to the present invention is eminently suitable for the production of dispersions of photographically-active organic hydrophobic substances in an aqueous medium. Examples of such substances include, for example, various types of hydrophobic couplers (4-equivalent couplers, 2-equivalent couplers, DIR couplers, masking couplers, white couplers, competing couplers), dyes or other colour-producing compounds, e.g. for the dye diffusion transfer process, UV absorbents, stabilizers and other photographic additives.

The aqueous phase contains hydrophilic colloidal binders, such as gelatine, to improve the stability of the dispersions. The gelatine may also be partly or completely replaced by other natural, synthetic or semi-synthetic binders, e.g. by derivatives of alginic acid or of cellulose, or by polyvinyl alcohol, polyacrylates, partially saponified polyvinyl acetate or polyvinyl pyrrolidone.

According to the present invention, the organic phase is heated to a temperature sufficiently above its melting point to form a low viscosity solution. This is dispersed in the aqueous phase, the residence time in the shearing zone of the dispersion apparatus generally being less than 1 second. The aqueous phase is introduced into the dispersion apparatus at a temperature which is preferably below the boiling point at normal pressure. The temperature of the aqueous phase is preferably from 70° to 95° C. While the aqueous phase may be left to circulate through the dispersion apparatus before the actual step of dispersion, the organic phase is not introduced until the beginning of dispersion, when it is introduced at a high temperature directly into the shearing zone of the dispersion apparatus.

According to the present invention, the temperature of the organic phase lies above the melting point of the organic substance which is to be dispersed, for example the coupler or the mixture of coupler and high boiling oil-former. Couplers having melting points of up to 180° C. may be processed without problems according to the present invention. The temperature of the organic phase is preferably from 100° to 140° C. The temperature of the organic phase falls to ambient temperature only during or after dispersion. The temperature in the shearing zone of the dispersion apparatus is generally from 60° to 140° C., in particular from 80° to 120° C. The temperature in the dispersion apparatus may, if desired, be controlled by means of additional devices. In order to avoid boiling of the aqueous phase in the dispersion apparatus, excess pressure may be maintained in the dispersion apparatus. The excess pressure chosen is calculated to prevent boiling and may be found from the boiling diagrams of the chosen systems. The excess pressure may be, for example, from 0 to 3 bar or higher.

The conventional machines may be used as dispersion apparatus, e.g. high speed stirrers, so-called "mixing sirens" or ultra-sound apparatus. In a preferred embodiment, the residence time in the shearing zone of the dispersion apparatus is only from 0.02 to 0.4 seconds. By "residence time" is meant the period from entry of the components to be dispersed into the shearing zone of the dispersion apparatus to the exit thereof. It is possible, however, to let the dispersion flow repeatedly through the shearing zone by superimposing circulation of the product. In that case, the effective residence times are generally from 0.2 to 6 seconds, and the dispersion components are repeatedly passed through the shearing zone of the dispersion apparatus so that the residence times add up to an average or effective residence time. These residence times are far below the residence times hitherto customary for the production of such emulsions.

The average particle size in the dispersions obtained is a function of residence time, mixing power and dispersion temperature. The influence of the residence time generally decreases with increasing mixing power. Finer dispersions may generally be obtained at higher temperatures than at lower temperatures. It is in principle possible to obtain various particle sizes, but particle sizes of from 200 to 600 nm are preferred, more particularly from 300 to 350 nm.

Even relatively temperature-sensitive substances may be dispersed at high temperatures in the dispersion apparatus. Another advantage of the process according to the present invention is that highly concentrated dispersions may be prepared at high volume/time yields.

The volume/time yield relates to known methods of preparation and known initial concentrations. If, for example, a given dispersion which is normally used at a concentration of 5% of active substance has to be produced in a reaction vessel, a smaller apparatus than usual may be used since the aqueous phase (gelatine solution) may be put into the process at a concentration of 25% and the organic phase may be prepared at a higher concentration. The volume/time yield may thus be improved by a factor of three simply by virtue to the smaller volume of the vessel. Since, in addition, the mixing times employed are usually 10 minutes, a further improvement by a factor of one hundred obtained with mixing times of 6 seconds (as indicated above).

The pressure in the dispersion apparatus should be above the vapour pressure of the aqueous phase. It is determined, inter alia, by the temperature of the organic phase (e.g. 120° C., corresponding to 2 bar excess pressure) which cools down to the temperature of the dispersion during the process of dispersion. If it is desired not to operate the reaction vessel for the aqueous phase at a pressure vessel, care must be taken to ensure that the temperature is below 100° C.; or alternatively, dispersion may be carried out at temperatures above 100° C. and, if the dispersion is to be returned to the reaction vessel, it must be cooled to temperatures below 100° C. before the excess pressure is released. The dispersing effect itself does not depend upon pressure, provided no evaporation occurs.

The ratio of organic substance (colour coupler, UV absorbent, etc.) to oil-former is not a critical factor for the success of the process. The oil-former (high boiling solvent) need not necessarily be used, but if dispersion is carried out at the preferred temperature it is advantageous not to exceed a viscosity of 1000 mPas. This may be suitably adjusted by the addition of oil-former.

The oil-formers are substances which generally boil at temperatures above 180° C. and have a good dissolving power for the hydrophobic substance to be dispersed. Among these substances, it is preferred to use esters of glutaric acid, adipic acid, phthalic acid, sebacic acid, succinic acid, maleic acid, fumaric acid, isophthalic acid, terephthalic acid or phosphoric acid or the esters of glycerol and paraffin and fluorinated paraffin because these compounds are chemically-resistant and very readily available, may be handled very easily and have no deleterious effect on light-sensitive materials when the dispersions are used for photographic purposes. According to the present invention, the following compounds are particularly preferred as oil-formers: tricresyl phosphate, triphenyl phosphate, dibutyl phthalate, di-n-octyl phthalate, di-2-ethyl-hexyl phthalate, glycerol tributyrate, glycerol tripropionate, dioctyl sebacate, paraffin and fluorinated paraffin. Succinic acid derivatives are also preferred. Examples are given below.

In the formulae quoted, R represents a relatively long aliphatic group having at least 8 carbon atoms. It is preferably one of the following monosaturated aliphatic groups: $-C_{12}H_{23}$, $-C_{15}H_{29}$ or $-C_{18}H_{35}$.

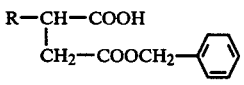
(1)

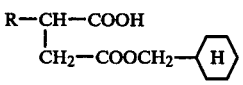
(2)

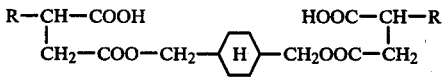
(3)

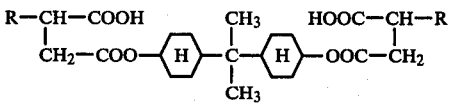
(4)

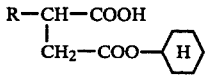
(5)

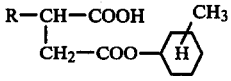
(6)

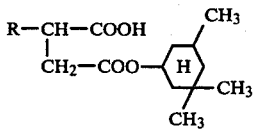
(7)

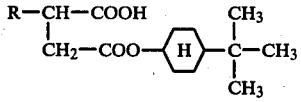
(8)

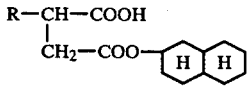
(9)

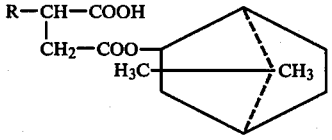
(10)

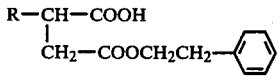
(11)

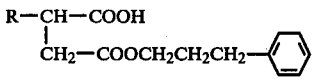
(12)

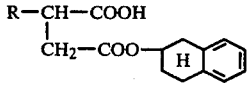
(13)

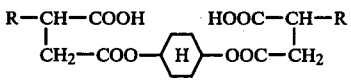
(14)

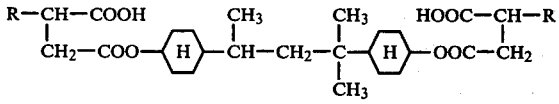
(15)

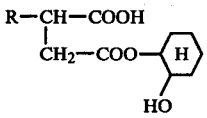
(16)

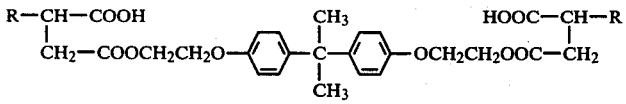
(17)

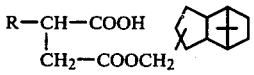
(18)

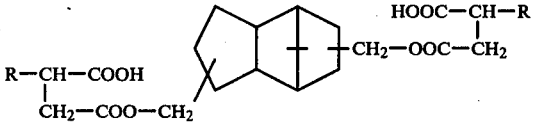
(19)

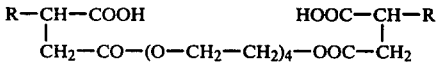
(20)

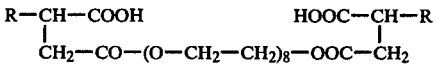
(21)

Figure 2:
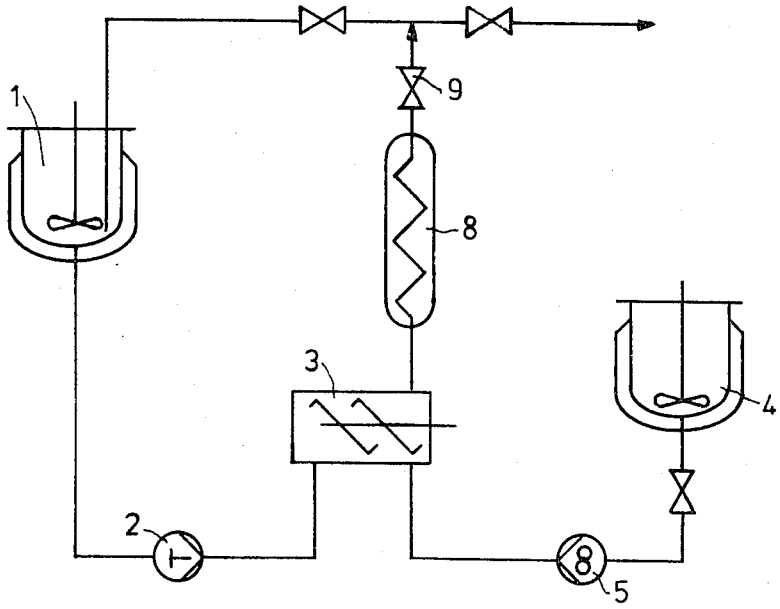

The process according to the present invention may be carried out using apparatus according to accompanying FIGS. 1 and 2 although it is not, of course, restricted to the use of such apparatus. According to accompanying FIG. 1, the aqueous phase is fed from a vessel 1 equipped with stirrer and heating means into a dispersing machine 3 by means of a pump 2 at a specified rate of flow.

The organic phase is directly fed into the shearing zone of the dispersing machine from another heatable and stirrable vessel 4 by means of pump 5 by way of a filter 6.

The dispersing machine 3 may be connected with by-pass 7.

The dispersion prepared in the dispersing machine may be sufficiently cooled in the heat exchanger 8 so that when leaving the pressure retaining valve 9 it has cooled to a temperature below the evaporation point at normal pressure and may be introduced into the vessel 10.

The apparatus may be operated continuously or batch-wise.

The dispersing machines used are preferably rotor/-stator machines since these enable the organic phase to be directly introduced into the shearing zone so that it may be dispersed at higher temperatures than the average dispersion temperature.

Accompanying FIG. 2 illustrates another embodiment. The reference numeral 1 indicates a reaction vessel into which the starting materials are introduced. The reference 2 indicates a pump which delivers the aqueous phase to the dispersing machine 3. The organic phase is fed from the vessel 4 by way of the pump 5. The cooler 8 enables the emulsified mixture to be cooled to temperatures below 100° C. so that no pressure need be applied after the release of pressure through the valve 9. The emulsion can be recycled through the reaction vessel 1.

The dispersions produced according to the present invention are eminently suitable for the production of light-sensitive photographic materials containing silver halide. The dispersions may be introduced into such materials in known manner. The dispersions may be introduced both into layers containing silver halide and into layers which are free from silver halide.

The conventional silver halide emulsions, produced by the conventional known methods, may be used. The binder used for the photographic layers may be gelatine, although this may be partly or completely replaced by other binders. Anti-fogging agents in the form of stabilisers, such as triazole derivatives, thiocarbonic acid derivatives of thiodiazole or azaindenes, may be added to the emulsions. The silver halide emulsions may in addition be sensitized using the conventional chemical sensitizers; the conventional sensitizers may be used for optical sensitization, for example, those described in the work by F. M. Hamer, "The Cyanine Dyes and Related Compounds" (1964), Interscience Publishers John Wiley & Sons.

Hardening of the photographic layers is carried out under conditions which do not have a deleterious effect on the image tone, but enable the layers to be rapidly processed even at elevated temperatures. Suitable hardeners include, for example, formalin, dialdehydes, divinyl sulphone, triazine derivatives, optionally in the presence of tertiary amines, instant hardeners, such as carbamoyl pyridinium compounds or carbodiimides. The conventional layer supports may be used, e.g. polyolefin-laminated supports, for example polyethylene-coated paper, suitable polyolefins and paper, polyesters or triacetate.

EXAMPLE 1

63,1 kg of an aqueous 25% gelatine solution is prepared in a heatable vessel equipped with a slow stirrer. When a clear solution has been obtained, 0.90 kg of triisopropyl naphthalene sulphonate is added. This aqueous solution is then heated to 80° C.

16.00 kg of tricresylphosphate are heated to 120° C. in a second vessel equipped with heating and stirring means, and there are then added, for example, 14.00 kg of coupler corresponding to the following formula:

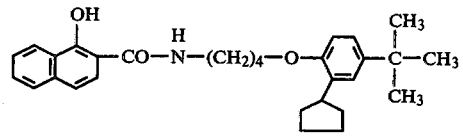

at 20° C. and 6.00 kg of the coupler 2-(2'-α-methyltridecyl-4'-chloro-phenoxyacetylamino)-4,6-dichloro-5-methyl-phenol and stirred in. A solution is formed which is clear at 120° C.

The aqueous gelatine solution is then pumped at a flow rate of 150 kg/h through the dispersion zone of a continuous flow mixer (Dispax Reactor, Model 3/6/6). The working chamber of this mixer is adjusted to a pressure of 2 bar by means of a restriction of the cross-section (valve) at the outflow. After its passage through the mixer, the aqueous solution is initially returned to its storage vessel so that the pipes and mixing zone become filled with liquid and are raised to the required temperature. Circulation of the aqueous gelatine solution is then terminated.

The second solution is then also delivered to the mixing zone through a heatable pipe by means of a heatable pump, in this case at a flow rate of 60 kg/h. The temperature at the outflow of the mixing zone rises to from 110° to 115° C. The pressure is maintained at from 2 to 2.5 bar. This pressure is approximately 1 bar higher than that required to prevent boiling of the aqueous phase.

EXAMPLE 2

The two solutions from Example 1 are prepared in ten times the quantity indicated therein, but the procedure differs in that the aqueous solution in the vessel is maintained at 40° C. and it is only immediately before the solution is pumped into the dispersing machine that it flows through a heat exchanger in which the temperature thereof is raised from 40° C. to 80° C.

In addition, the solid, pulverulent couplers from Example 1 are mixed and introduced into the shaft of a solution screw which is at the same time supplied with tricresyl phosphate heated to 120° C. so that the solution is continuously formed, the residence time at an elevated temperature of 115° C. being only a few seconds.

EXAMPLE 3

25.00 kg of a 25% gelatine solution and 1.02 kg of triisopropyl naphthalene sulphonate (solution I) are prepared at 60° C. in accordance with Example 1 are introduced into a heatable and coolable vessel equipped with a slowly rotating stirrer, and 50.00 kg of dibutylphthalate and 25.00 kg of a compound corresponding to the formula:

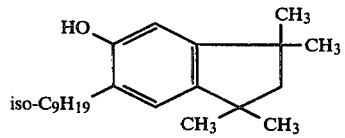

are heated to 140° C. in a second vessel equipped with heating means and stirrer, and 50.00 kg of coupler corresponding to the formula:

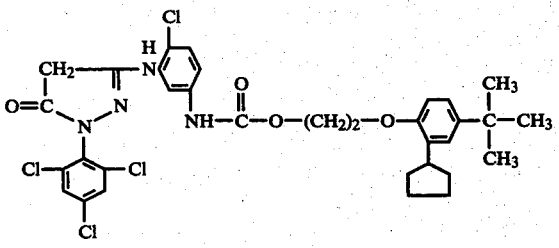

are added and the mixture is stirred until a clear solution (solution II) is obtained at 130° C.

Both solutions are continuously fed by means of piston feed pumps into a continuous flow mixer of the rotor/stator type which is operated at a speed of 10,000 revs/min. Solution I is fed in at a flow rate of 120 kg/h and solution II at a rate of 60 kg/h.

The continuous flow mixer is connected for circulation. A finely divided emulsion is formed in the continuous stream at a pressure of 2 bar and a temperature of from 110° to 120° C. This emulsion is cooled to 80° C. in an attached downstream cooler to be worked-up after passing through a pressure retaining valve adjusted to 2 bar. An emulsion having an average particle size of 337 nm is obtained.

The resulting dispersion is added in known manner to a silver halide emulsion having a silver halide content of 60 g/l. Hardeners and wetting agents are added to the dispersion, which is then cast on a support in known manner. The material obtained is image-wise exposed and developed in a conventional colour developer.

For comparison, a similar photographic material is prepared from the same silver halide emulsion using the same dispersed compounds, but the process of dispersion was not carried out in accordance with the present invention, but according to U.S. Pat. No. 2,322,027. To prepare the dispersion, the quantities of couplers and oil-formers indicated above are dissolved in 150 kg of diethyl carbonate. The solution obtained is run into the 10% gelatine solution (quantity corresponding to 25 kg of gelatine) containing the quantity of wetting agent indicated above, and the mixture is prepared with stirring. This mixture is repeatedly passed through a mixing siren to be dispersed. The solvent is thereafter evaporated off under vacuum. The resulting emulsion is added to the silver halide emulsion.

The comparison material was worked-up in the same manner as the material according to the present invention.

The sensitometric data given in the following Table show that higher sensitivity, gradation and maximum density are obtained according to the present invention.

| | Sensitivity | Gradation | $D_{max}$ |
|---|---|---|---|
| Invention | 1.90 | 1.5 | 2.14 |
| Comparison | 2.02 | 1.3 | 1.93 |

Decreasing of the sensitivity value by 0.3010 units corresponds to doubling of the sensitivity.

EXAMPLE 4

25.00 kg of gelatine solution and 0.5 kg of triisopropyl naphthalene sulphonate are prepared at 60° C. as in Example 1 (solution I) in a heatable and coolable vessel equipped with a slow stirrer. The concentrations of the gelatine solutions are chosen to be 7.5%, 10%, 15% and 20%. The gelatine solutions are introduced into the reaction vessel and 5 kg of tricresyl phosphate and 5 kg of a compound corresponding to the formula:

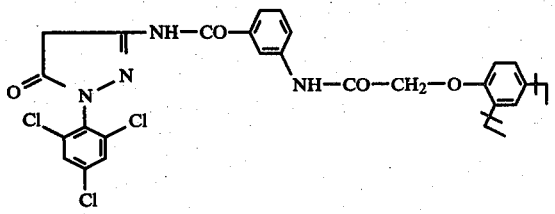

are heated to 140° C. in a second vessel equipped with heating means and stirrer and stirred until clear solution (solution II) is obtained.

Both solutions are continuously fed into a continuous flow mixer of the rotor/stator type rotating at 10,000 revs/min by means of piston feed pumps, solution I being fed at a flow rate of 120 kg/h and solution II at a rate of 60 kg/h.

The continuous flow mixer is connected for circulation. A finely divided emulsion is formed in a continuous stream at a pressure of 2 bar and a temperature of from 110° to 120° C. This emulsion is cooled to 80° C. in a downstream cooler to be subsequently worked-up after passing through a pressure retaining valve adjusted to 2 bar.

Emulsions having particle sizes of from 625 to 350 nm are obtained.

EXAMPLE 5

53.1 kg of a 10% gelatine solution and 5.3 kg of a 50% solution of the sodium salt of dodecyl benzene sulphonic acid and 21.3 kg of water prepared at 60° C. as in Example 1 (solution I) are introduced into a vessel equipped with heating and cooling means and a slowly rotating stirrer, and 20.9 kg of a compound corresponding to the formula:

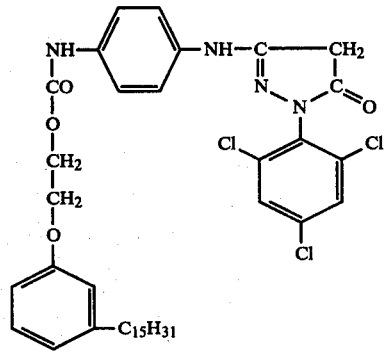

are heated in a second vessel equipped with heating means and stirrer and stirred until a clear solution is obtained at 130° C. having a viscosity of 750 mPas. Both solutions are continuously fed into a continuous flow mixer of the rotor/stator type operating at 10,000 revs/min, using piston feed pumps, solution I being fed at a flow rate of 120 kg/h and solution II at a flow rate of 60 kg/h.

The continuous flow mixer is connected for circulation. A finely divided emulsion is formed in a continuous stream at a pressure of 1 bar and a temperature of 95° C. The emulsion is cooled to 80° C. and worked-up.

We claim:

1. In the process for the production of a dispersion of at least one liquid organic phase containing a hydrophobic, photographically-active substance.

and at least one aqueous phase containing a binder, by combining the phases in a dispersion by introducing said organic phase and said aqueous phase separately and simultaneously into a dispersion unit, and combining said phases in said unit at a temperature maintained at 100° C. or higher and under a pressure maintained at least 1 bar so as to disperse the phases in the dispersion unit.

2. Process according to claim 1, characterised in that the organic phase is the pure melt of a photographically-active substance and in that dispersion takes place above the liquefaction temperature of this photographically active substance.

3. Process according to claim 1, characterised in that the organic phase is the solution of a photographically-active substance in an oil-former (high boiling solvent) and in that dispersion takes place above the liquefaction temperature of this solution.

4. Process according to claims 1, 2 or 3, characterised in that the organic phase and the aqueous phase are dispersed at a temperature above the liquefaction temperatures of both phases.

5. Process according to claim 1, characterised in that dispersion is carried out at a temperature above the boiling point at normal pressure of the lower boiling phase or of the azeotropic mixture if such a mixture is formed.

6. Process according to claim 1, characterised in that the organic phase contains substances which are substantially immiscible or insoluble in water at pH 7 and in that the aqueous phase contains gelatine.

7. Process according to claim 1, characterised in that the organic phase contains an oil-former in addition to the active substance.

8. Process according to claim 1, characterised in that the photographically-active compound is a colour coupler, a stabilizer or a UV absorbent.

9. Process according to claim 1, characterised in that the residence time of a particle of the organic phase in the shearing zone of the dispersion apparatus is at the most 6 seconds.

10. Process according to claim 1, characterised in that the temperature of the organic phase is from 100° to 140° C., the temperature of the aqueous phase is from 70° to 95° C.

11. Photographic material consisting of a layer support, at least one silver halide emulsion layer and optionally other layers, characterised in that at least one layer contains a dispersion prepared according to claim 1.

* * * * *